United States Patent [19]

Inoue et al.

[11] 4,105,322

[45] Aug. 8, 1978

[54] ELECTROPHOTOGRAPHIC COLOR PROCESS

[75] Inventors: Motoichiro Inoue, Yokohama; Tsuyoshi Shiga, Urawa; Nobuo Kasahara, Yokohama, all of Japan

[73] Assignee: Ricoh Company, Ltd., Tokyo, Japan

[21] Appl. No.: 722,027

[22] Filed: Sep. 10, 1976

[30] Foreign Application Priority Data

Sep. 12, 1975 [JP] Japan ..... 50-111327
Sep. 12, 1975 [JP] Japan ..... 50-111328

[51] Int. Cl.[2] ..... G03G 15/01
[52] U.S. Cl. ..... 355/4; 355/3 TE
[58] Field of Search ..... 355/3 R, 3 RX, 3 TE, 355/3 TR, 4

[56] References Cited

U.S. PATENT DOCUMENTS 3,811,764 5/1974 Forest ..... 355/4 X
3,972,714 8/1976 Weber et al. ..... 355/3 TE X

OTHER PUBLICATIONS

Xerox Disclosure Journal, "High Frequency Pulsed Bias Roller Transfer System," vol. 1, No. 5, May 1976, p. 83.

*Primary Examiner*—William M. Shoop
*Attorney, Agent, or Firm*—Cooper, Dunham, Clark, Griffin & Moran

[57] ABSTRACT

In an electrophotographic process in which an electrostatic latent image formed on the surface of a photosensitive member according to conventional electrophotography is transferred onto a latent image receptor sheet and the transferred latent image converted into a visual image with a developer, the improvement that when the receptor sheet is brought into contact with the photosensitive member to transfer the latent image from it onto the sheet, a bias voltage containing a high frequency component is applied across the member and the sheet facilitating a positive and uniform transfer to improve the continuous tone quality of the resulting image.

2 Claims, 11 Drawing Figures

ELECTROPHOTOGRAPHIC COLOR PROCESS

BACKGROUND OF THE INVENTION

The invention relates to an improvement in the electrophotographic process.

To improve the reproduction of a continuous tone in an image reproduced by electrophotography, the placement of a dot screen on an imaging plane of an exposure optical system to divide the resulting image into dot patterns has been proposed. However, this approach is susceptible to moire effect and also suffers from a poor resolving power. The formation of a photosensitive member in a dot pattern avoids the problem of moire effect, but again involves a reduced resolving power. A further approach employs the etching of the conductive layer of the photosensitive member into very thin stripe form to disturb the electric spatial field during the transfer step, but this method involves technical difficulties and is expensive.

SUMMARY OF THE INVENTION

It is an object of the invention to provide an electrophotographic process capable of improving the continuous tone quality in reproduced images in an easy and inexpensive manner without degrading the resolving power.

In an electrophotographic process in which an electrostatic latent image formed on the surface of a photosensitive member according to normal electrophotography is transferred onto a latent image receptor sheet by bringing the latter into contact with said surface, and in which the transferred latent image on the sheet is converted into a visual image with a developer, the present invention proposes the application of a bias voltage containing a high frequency component across the photosensitive member and the receptor sheet during the transfer of the latent image therebetween.

The application of a bias voltage containing a high frequency component in the manner mentioned above causes the high frequency component to oscillate the potential about the potential in the image areas between an up level and a down level in the region where the sheet begins to contact the photosensitive member and in the region where they begin to be separated, thereby allowing a transfer process to take place in a positive and uniform manner to improve the continuous tone quality of the resulting image.

A suitable bias voltage for transfer which contains a high frequency component can be applied across the photosensitive member and the latent image receptor sheet by using an electrically conductive roller of rubber, for example, to maintain the receptor sheet against the photosensitive member while connecting a high frequency generator between the roller and the photosensitive member.

The invention may be applied to a color electrophotographic copying process which comprises the steps of uniformly charging the surface of a photosensitive member; then irradiating the surface with a selected actinic ray, corresponding to an image on an original and passed through a color separation filter, to thereby form an electrostatic latent image which corresponds to the selected ray; then bringing an electrostatic latent image receptive sheet into contact with the surface of the photosensitive member on which the latent image is formed to thereby transfer it onto the sheet; developing the transferred latent image with a developer which is chosen in dependence upon the fiter used; and repeating the described series of steps while changing the color of filter and developer; by applying a bias voltage containing a high frequency component across the photosensitive member and the receptor sheet each time a latent image is transferred therebetween.

DESCRIPTION OF PREFERRED EMBODIMENT

Figure 1:
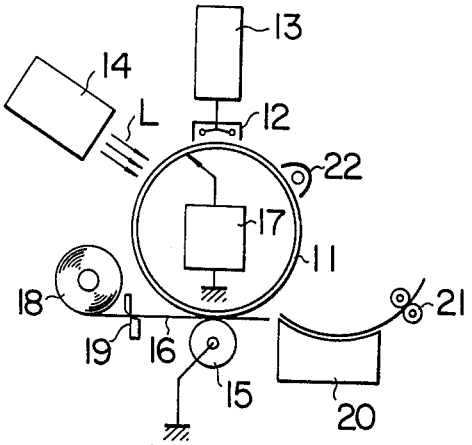
FIG. 1 is a schematic side elevation of an electrophotographic copying machine which is adapted to practice the process of the invention.

Referring to FIG. 1, there is shown a photosensitive member 11 in the form of an electrically conductive drum having a photoconductive, insulating layer disposed on the surface thereof. The member 11 is adapted to be driven by drive means, not shown, for rotation at a uniform rate. The surface of the member 11 is uniformly charged by a charger 12 such as a corona discharge unit, which is supplied with a high voltage for its operation from a high tension supply 13. Subsequent to the charging, the member 11 is exposed to actinic radiation L, as shown which is directed by an exposure unit 14 of a known form in accordance with the image of an original, whereby an electrostatic latent image is formed on the surface of the member 11. Subsequently, the area of the member 11 which carries the latent image sequentially moves into contact with a latent image receptor sheet 16 which is urged thereagainst by a transfer roller 15, thus transferring the latent image. In the present example, the photosensitive member 11 comprises a drum-shaped conductive support of aluminium or other metallic material having a photoconductive insulating layer thereon, and a high frequency generator 17 is electrically connected between the conductive support and the ground for applying a bias voltage containing a high frequency component to the support. The receptor sheet 16 comprises a dielectric material while the transfer roller 15 is connected with the ground. Thus, the bias voltage containing the high frequency component is applied across the photosensitive member 11 and the receptor sheet 16 during the transfer step of the latent image. This greatly improves the continuous tone quality on the latent image as the high frequency potential of a given magnitude causes the potential to oscillate between an up level and a down level about the potential in the image regions where the receptor sheet begins to contact the member 11 and where it begins to be separated therefrom, thus achieving a positive and uniform transfer. The receptor sheet 16 is formed by a length of sheet material disposed in a roll form as shown at 18 and is cut by a cutter 19, and then fed into the nip between the photosensitive member 11 and the transfer roller 15. Subsequent to the transfer step, the sheet 16 is fed into a developing unit 20 of a wet type where it is developed, and thence to the nip between a pair of squeeze rollers 21, which act to remove any excess amount of developing solution. Finally the sheet 16 is dried in a fixing unit, not shown. After completion of the transfer step, the photosensitive member 11 is discharged by irradiation from a lamp 22.

Figure 2:
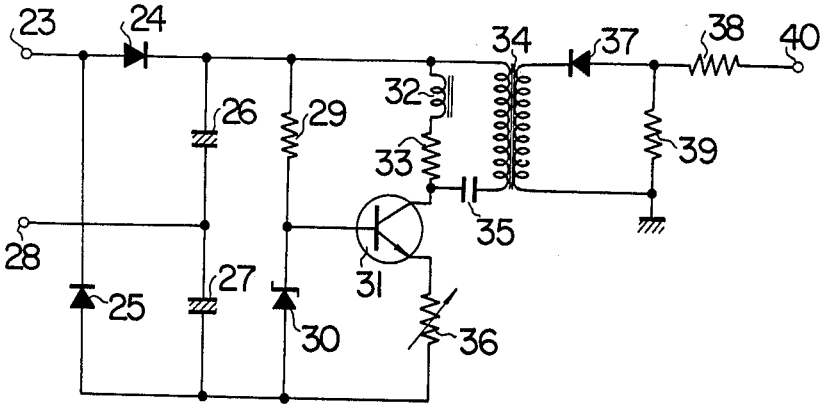
FIG. 2 is a circuit diagram of a high frequency generator which may be used in the apparatus shown in FIG. 1 to carry out the process of the invention.

FIG. 2 shows one form of the high frequency generator 17. Specifically, it includes a terminal 23 which is connected with the anode of a diode 24 and the cathode of a diode 25, a pair of capacitors 26, 27 being connected in series between the cathode of the diode 24 and anode of the diode 25. The junction between the capacitors 26, 27 is connected with a terminal 28, and a source of 100 volts A.C. is connected across terminals 23, 28. The described circuit components constitute together a voltage doubler. The junction between the diode 24 and the capacitor 26 is connected through a resistor 29 with the cathode of a constant voltage diode 30 and the base of an NPN transistor 31, and is also connected through a series path including a choke coil 32 and a resistor 33 with the collector of the transistor 31. A series circuit comprising a primary winding of a transformer 34 and a capacitor 35 is connected in shunt with the series path including the choke coil 32 and the resistor 33. The junction between the diode 25 and the capacitor 27 is connected with the anode of the diode 30 and is also connected through a variable resistor 36 with the emitter of the transistor 31. The described circuit components which are connected with the voltage doubler and with each other in the manner mentioned above constitute together an oscillator circuit. A secondary winding of the transformer 34 has one end connected with the ground and has its other end connected with the cathode of a diode 37, the anode of which is connected with the junction between a pair of resistors 38, 39 which are connected in series between an output terminal 40 and the ground.

Figure 3:
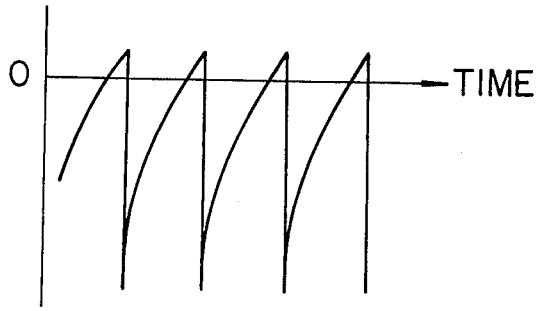
FIG. 3 is a waveform diagram for the output of the generator shown in FIG. 2.

In one practical embodiment, a circuit arrangement as shown in FIG. 2 has been constructed so that a high frequency voltage as shown in FIG. 3 is produced at the output terminal 40 which exhibits a negative peak voltage of −250 to −500 volts, a peak-to-peak voltage of 270 to 550 volts, a root mean value of −120 to −230 volts and a frequency of 10 KHz. A frequency $f$ may be chosen which satisfies the following inequality:

$$f/v \geqq 3.2$$

where $v$ represents the linear speed of transfer in mm/sec.

Figure 4:
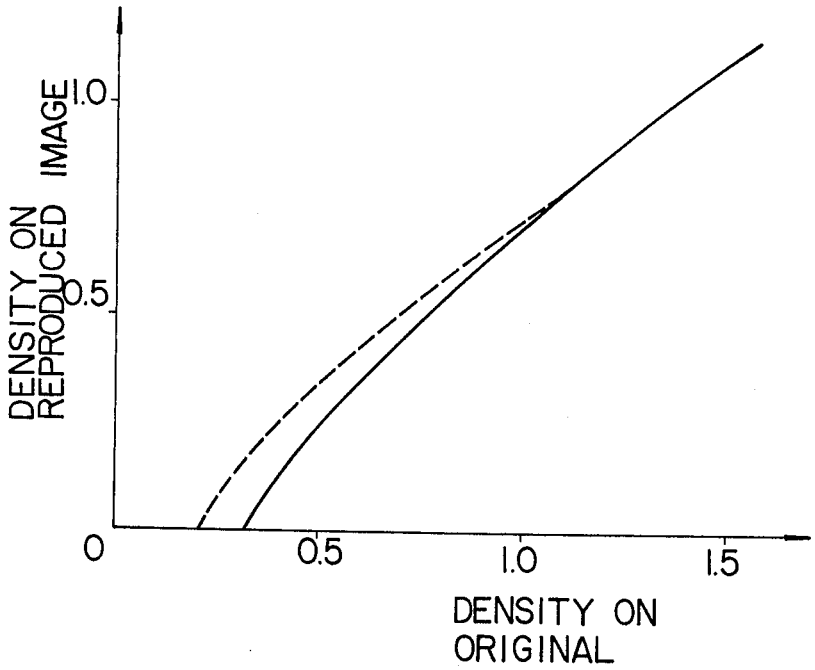
FIG. 4 graphically shows the relationship between the density on the original and the density on the reproduced image when a d.c. bias voltage and when a high frequency bias voltage is employed during the transfer step of the latent image.

When the bias voltage as shown in FIG. 3 and as mentioned above is applied, the density on the reproduced image (taken on the ordinate in FIG. 4) is improved, as indicated by a dotted line curve of FIG. 4, over that when a constant d.c. bias voltage is used, which is indicated by a solid line curve. In FIG. 4, the abscissa represents the density on the original.

Figure 5:
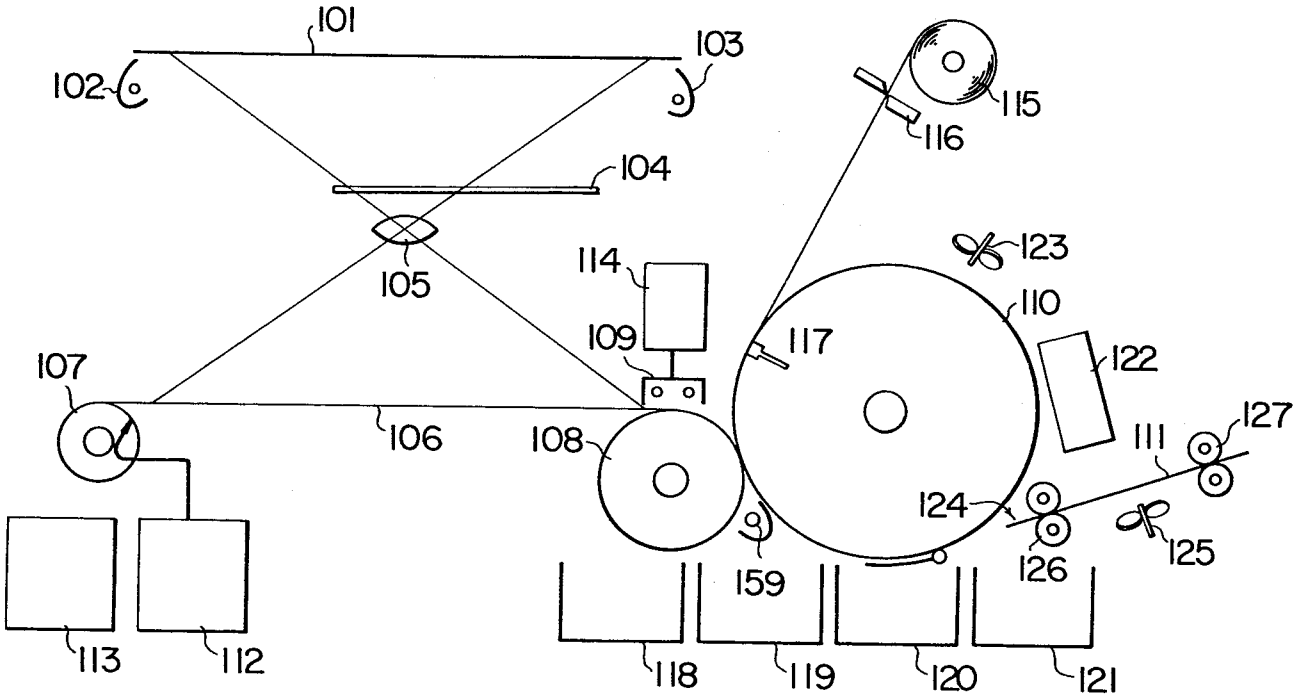
FIG. 5 is a schematic side elevation of another electrophotographic copying machine which is also adapted to practice the process of the invention.

Referring to FIG. 5, there is shown an apparatus which is adapted for use in color electrophotography. An original 101 is disposed for flash irradiation by a pair of light sources 102, 103, and actinic radiation reflected by the original 101 is passed through a color separation filter 104 and focussed by a lens 105 onto a film 106 which represents a photosensitive member. As is well recognized, the color separation filter 104 operates to separate the actinic radiation into a plurality of primary or different color components. The film 106 has its opposite ends anchored to a pair of drums 107, 108, and a length thereof which is at least equal to the length of the original 101 is wraped around the drum 108. During a counterclockwise rotation of the drums 107, 108, the film 106 is initially uniformly charged all over its surface by a charger 109 before it is moved to its exposure position where it is exposed to actinic radiation from the lens 105, thereby producing an electrostatic latent image thereon. Subsequently, the drums 107, 108 are driven for rotation in the clockwise direction to move the film 106 to its transfer position. Thus as the film passes through the nip between the drum 8 and a transfer drum 110, it is sequentially brought into lineal contact with a receptor sheet 111 which comprises a dielectric material, thus transferring the latent image onto sheet 111. Any trace of the latent image which remains on the film 106 is eliminated by the action of a discharger lamp 159.

The film 106 is reciprocately moved between the exposure and the transfer positions as the drums 107, 108 rotate in opposite directions for each color separation by the filter 108, thus forming an electrostatic latent image corresponding to each color separation and transferring it onto the receptor sheet 111 in superimposed relationship with each other. In accordance with the invention, a high frequency bias circuit 112 applies a bias voltage containing a high frequency component to the conductive layer of the film 106 during the transfer of the respective images, which bias is applied across the film 106 and the sheet 111 through the transfer drum 110, thereby greatly improving the continuous tone quality of the resulting image. The bias circuit 112 is controlled by a bias control circuit 113 so that a suitable bias voltage is applied to the film 106 for each color separation by the filter 104.

A high voltage is applied to the charger 109 from a high tension source 114. The receptor sheet 111 is supplied from a roll 115 and is cut to a desired length by a cutter 116. The length of the receptor sheet is secured to the transfer drum 110 by means of clamper 117. The drum 110 is rotated at the same peripheral speed as the drum 108, and is driven through one revolution each time a latent image is transferred from the film 106 to the receptor 111. There are provided a plurality of developer tanks 118–121, which are selectively and alternately moved to a developing position for each revolution of the transfer drum 110, thereby developing the latent image transferred onto the sheet 111 with a developing solution of a color contained in one of the tanks 118 to 121 which corresponds to a particular color separation which produced or formed the latent image eventually transferred to the sheet 111. The elimination of any residual charge on the sheet 111 takes place by a discharger 122 and the sheet is dried by a fan 123 subsequent to the transfer and developing steps during each revolution of the transfer drum 110 until the individual latent images transferred are developed in superimposed manner with developing solutions of different colors. Finally, the receptor sheet 111 is separated from the drum 110 by separator claws at 124, dried by a fan 125, and conveyed to a utilization unit by means of coveyor rollers 126, 127.

Figure 6:
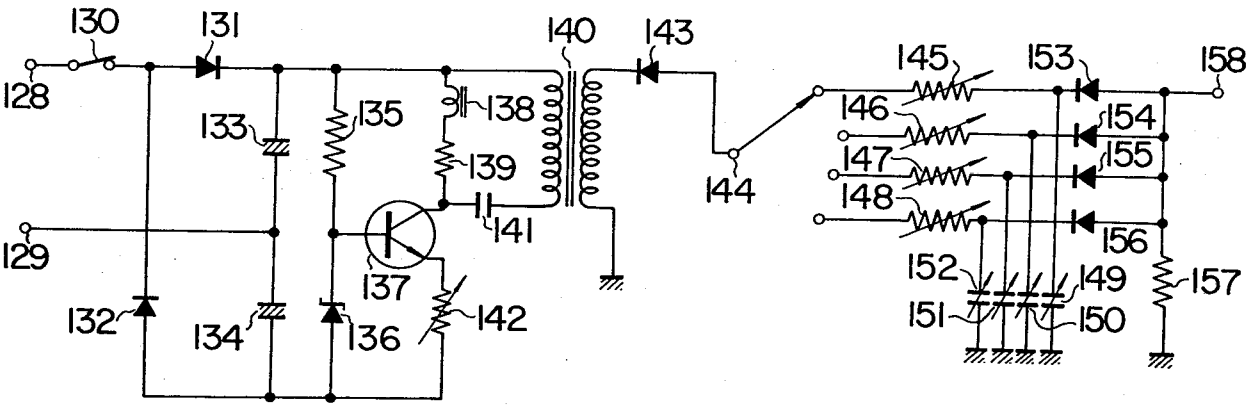
FIG. 6 is a circuit diagram of a high frequency generator which may be used in the apparatus shown in FIC 5.

The high frequency bias circuit 112 and the bias control circuit 113 may be constructed as shown in FIG. 6. Specifically, there are provided a pair of terminals 128, 129 across which a source of 100 volts A.C. is connected. The terminal 128 is connected through a switch 130 with the anode of a diode 131 and the cathode of a diode 132. The switch 130 is adapted to be closed when a latent image on the film 106 is to be transferred to the receptor sheet 111. A pair of capacitors 133, 134 are connected in series between the cathode of the diode 131 and the anode of the diode 132, and the junction between the capacitors 133, 134 is connected with the terminal 129. The described circuit components constitute together a voltage doubler.

The junction between the diode 131 and the capacitor 133 is connected through a resistor 135 with the base of an NPN transistor 137 and the cathode of a constant voltage diode 136, and is also connected through a series path including a choke coil 138 and a resistor 139 with the collector of the transistor 137. A series circuit formed by the primary winding of a transformer 140 and a capacitor 141 is connected in shunt with the series path mentioned above. The junction between the diode 132 and the capacitor 134 is connected with the anode of the diode 136 and is also connected through a variable resistor 142 with the emitter of the transistor 137. The described circuit components form together an oscillator circuit. The secondary winding of the transformer 140 has its one end connected with the ground and has its other end connected with the cathode of a diode 143, the anode of which is in turn connected with a movable contact of a switch 144. This switch includes a plurality of stationary contacts, which are separately connected with the ground through a plurality of series combinations of variable resistors 145 to 148 and variable capacitors 149 to 152. The switch 144 is successively changed from one position to another during the time when the switch 130 is turned off, in synchronized relationship with the switching of color in the color separation filter 104 or with the movement of the individual developing tanks 118 to 121 to the developing position. It will be noted that the series combinations of variable resistor 145 to 148 and variable capacitors 149 to 152 represent time constant circuits which permit an adjustment of the frequency of the high frequency component. The junctions between the variable resistors 145 to 148 and the variable capacitors 149 to 152 are connected with the cathode of diodes 153 to 156, respectively, the anode of which is connected in common with an output terminal 158 and also with one end of a resistor 157, the other end of which is connected with the ground.

Figure 7:
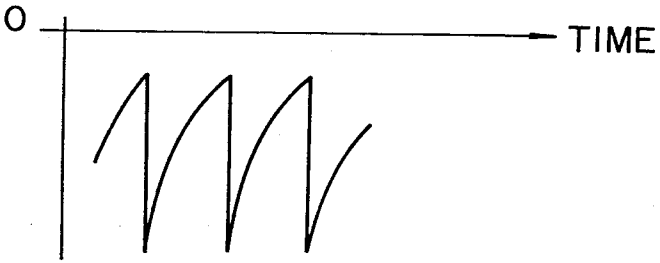
FIG. 7 graphically shows the output waveform of the generator shown in FIG. 6.
Figure 8A:
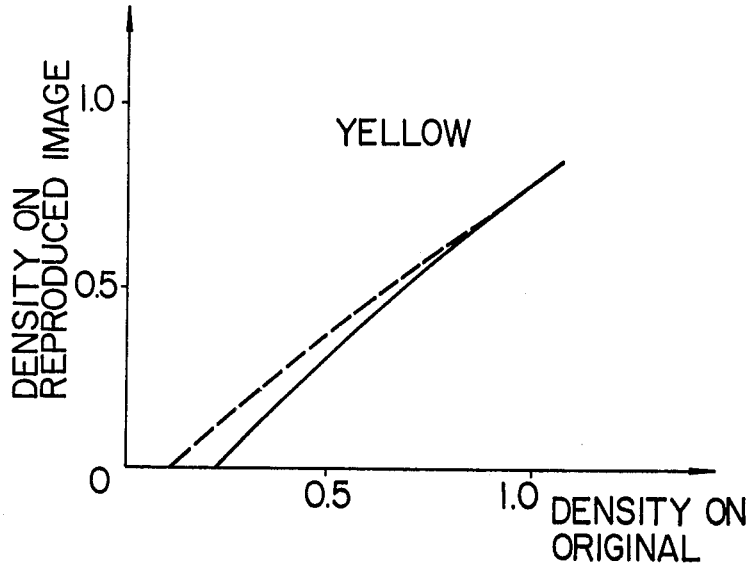
FIGS. 8 (A) to (D) graphically show the relationship between the density on the original and the density on the reproduced image for different colors of the developer when a d.c. bias voltage and when a high frequency bias voltage is employed, FIG. 8 (A) being for yellow developer, FIG. 8 (B) for magenta developer, FIG. 8 (C) for cyan developer and FIG. 8 (D) for black developer.
Figure 8B:
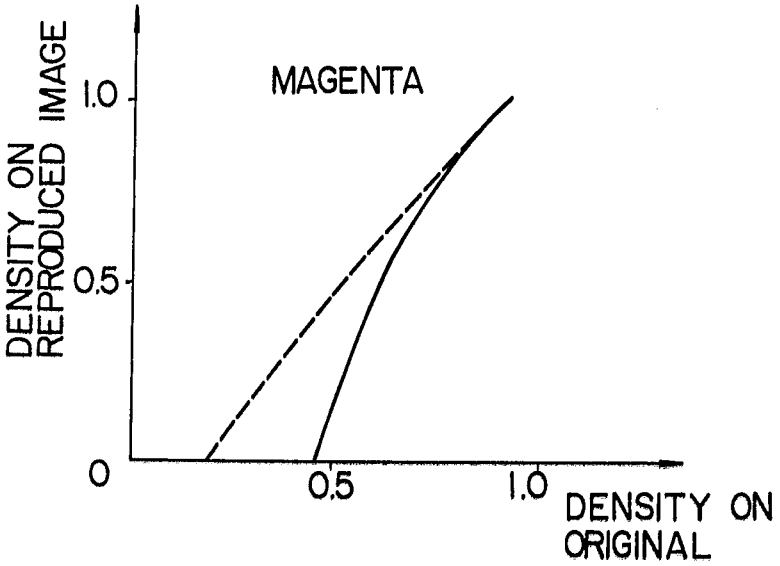
Figure 8C:
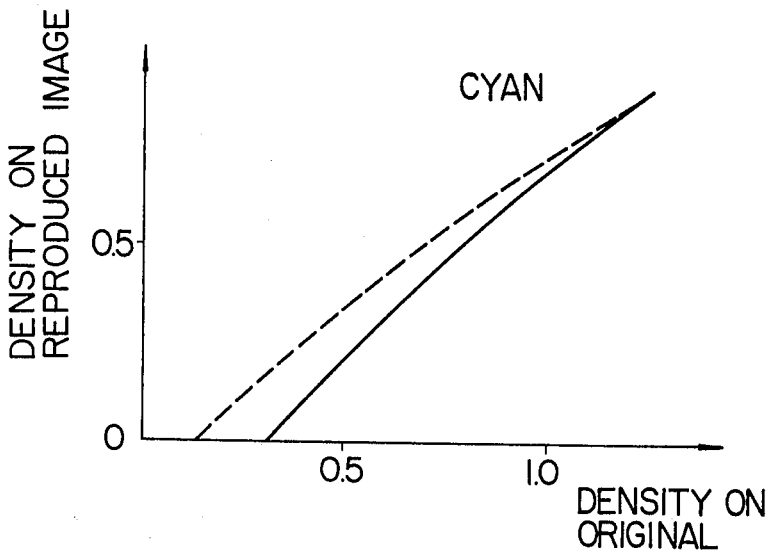
Figure 8D:
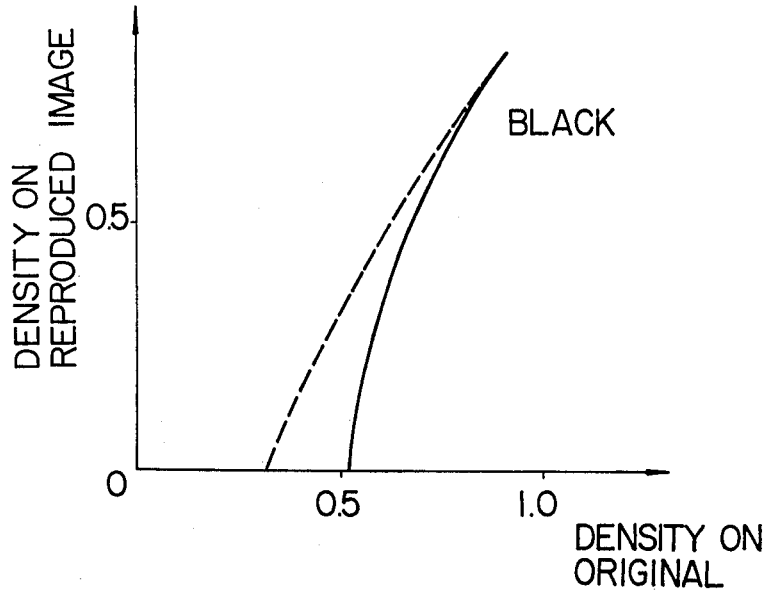

During the transfer of the electrostatic latent image, the switch 130 is closed to energize the oscillator circuit, the output of which passes through the diode 143 and is distributed by the switch 144, in synchronized with the switching of color in the color separation filter 104, to a suitable one of the series combinations of the variable resistors 145 to 148 and the variable capacitors 149 to 152, thereby providing a properly adjusted high frequency component at the output terminal 158. The output appearing at the output terminal 158 may have a waveform as shown in FIG. 7. In one example, the oscillation output has a maximum voltage of −500 volts, a peak-to-peak value of 0 to −500 volts, a root mean square value of −120 to −550 volts, and a frequency $f$ of 10 kHz. The frequency $f$ may be chosen to satisfy the following inequality:

$$f/v \geqq 3.2$$

where $v$ stands for the speed of transfer of the latent image represented in mm/sec.

Where yellow, magenta, cyan and black colors are utilized in the color separation, the relationship between the density on the reproduced image and the density on the original with the application of the high frequency bias voltage mentioned above is represented by dotted line curves shown in FIGS. 8(A) to (D) respectively. A distinct improvement is noted in FIGS. 8(A) to (D) over the use of a constant d.c. bias voltage which is illustrated by solid line curves for the respective colors.

What is claimed is:

1. An electrophotographic process comprising th- steps of:

(a) uniformly charging the surface of a photosensitive member;

(b) irradiating said surface with actinic radiation which is passed through a color separation filter in accordance with the image of an original for forming an electrostatic latent image of said origina on said surface, which latent image corresponds to the actinic rays passing through the color separation filter;

(c) bringing an electrostatic latent image receptive sheet into contact with the surface of the photosensitive member on which the latent image is formed for transferring the latent image thereon onto the receptive sheet;

(d) developing the transferred latent image with a developer which is chosen in dependence on the filter used in step (b); and (e) repeating the described series of steps with different filters and with developers of corresponding colors, for producing a color copy; wherein the improvement comprises:

(f) applying a bias voltage containing a high frequency component across the photosensitive member and the receptive sheet during each of the repeated steps of transferring the latent image from the photosensitive member to the receptive sheet; and (g) sequentially switching the high frequency component of the bias voltage to an optimum frequency for each color by selectively applying said bias voltage across respective capacitive time constant circuits during each repeated step for uniformly transferring each of said latent images.

2. A process as in claim 1 wherein the frequency $f$ of the high frequency component of said bias voltage satisfies the relationship $f/v \geqq 3.2$ where $v$ represents the speed of transfer of the latent images in mm/sec.

* * * * *